US010669868B2

(12) United States Patent
Pieri

(10) Patent No.: US 10,669,868 B2
(45) Date of Patent: Jun. 2, 2020

(54) TURBINE BLADE AND LOCKING SET

(71) Applicant: Nuovo Pignone Tecnologie Srl, Florence (IT)

(72) Inventor: Marco Pieri, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 134 days.

(21) Appl. No.: 15/849,823

(22) Filed: Dec. 21, 2017

(65) Prior Publication Data

US 2018/0179903 A1 Jun. 28, 2018

(30) Foreign Application Priority Data

Dec. 22, 2016 (IT) ..... 102016000130088

(51) Int. Cl.

*F01D 5/32* (2006.01)
*F01D 5/30* (2006.01)
*F04D 29/32* (2006.01)

(52) U.S. Cl.

CPC ..... *F01D 5/32* (2013.01); *F01D 5/3007* (2013.01); *F01D 5/323* (2013.01); *F01D 5/326* (2013.01); *F04D 29/322* (2013.01); *F05D 2230/60* (2013.01); *F05D 2230/644* (2013.01); *F05D 2240/24* (2013.01); *F05D 2260/30* (2013.01)

(58) Field of Classification Search

CPC . F01D 5/323; F01D 5/32; F01D 5/326; F01D 5/3007

See application file for complete search history.

(56) References Cited

U.S. PATENT DOCUMENTS 5,431,543 A 7/1995 Brown et al.
6,905,311 B2 * 6/2005 Leathart ..... F01D 5/323 416/221

(Continued)

FOREIGN PATENT DOCUMENTS

DE 1 079 073 B 4/1960
EP 1 892 380 A1 2/2008

(Continued)

OTHER PUBLICATIONS

Italian Search Report and Written Opinion issued in connection with corresponding IT Application No. 2016000130088 dated Aug. 8, 2017.

(Continued)

*Primary Examiner* — Ninh H. Nguyen
*Assistant Examiner* — Behnoush Haghighian
(74) *Attorney, Agent, or Firm* — Baker Hughes Patent Organization

(57) ABSTRACT

Fixing set for securely assembling and locking a blade shaped element, for instance a turbine blade, on a support, for instance a turbine rotor. The blade shaped element is adapted to be inserted into a groove of the external surface of the support and the fixing set includes first, second and third locking elements adapted to be inserted into the groove, between the lower end surface of the root portion of the blade shaped element and the groove base surface. The first, second and third locking elements are adapted to securely lock the blade shaped element on the support and are further adapted to allow easy and simple installation by an operator with no need of additional working and extra machining.

12 Claims, 5 Drawing Sheets

(56) References Cited

U.S. PATENT DOCUMENTS

| | | | | |
|---|---|---|---|---|
| 8,956,122 | B2 * | 2/2015 | Helmis | F01D 5/323 416/221 |
| 2004/0062653 | A1 | 4/2004 | Di Paola et al. | |
| 2009/0324414 | A1 * | 12/2009 | Helmis | F01D 5/3015 416/220 R |
| 2010/0284805 | A1 * | 11/2010 | Uskert | F01D 5/323 415/209.3 |
| 2013/0216387 | A1 * | 8/2013 | Torkaman | F01D 5/323 416/220 R |
| 2014/0356178 | A1 * | 12/2014 | Luketic, IV | F01D 5/3053 416/220 R |
| 2015/0176417 | A1 | 6/2015 | Zelmer | |
| 2015/0330235 | A1 | 11/2015 | Polyzopoulos et al. | |
| 2016/0265369 | A1 * | 9/2016 | Benson | F01D 5/323 |
| 2018/0266259 | A1 * | 9/2018 | Rehnsch | F01D 5/323 |

FOREIGN PATENT DOCUMENTS

| | | | |
|---|---|---|---|
| EP | 2 808 490 | A1 | 12/2014 |
| EP | 3 073 054 | A1 | 9/2016 |

OTHER PUBLICATIONS

Extended European Search Report and Opinion issued in connection with corresponding EP Application No. 17209314.8 dated Apr. 5, 2018.

* cited by examiner

TURBINE BLADE AND LOCKING SET

FIELD OF INVENTION

Conventional turbomachines such as, for example, gas and steam turbines, comprise a rotor including a plurality of rotor disks, each supporting a plurality of rotor blades fixed to its peripheral surface, along with a stator including a case with stator blades; the rotor and the case of the stator define, in combination, a channel along which a working fluid (gas) is expanded and undergoes a thermodynamic transformation, associated to the rotation of the rotor blades with respect to the stator blades.

BACKGROUND OF THE INVENTION

According to the most common solutions, each of the rotor blades comprises an airfoil portion and a root portion, wherein the root portion is received in a corresponding retaining groove formed on the peripheral surface of the rotor disk, and wherein the groove and the root portion have matching shapes and dimensions. In particular, and still according to the most common solutions, in rotor blades of axial insertion type, the root of each rotor blade is usually of a so-called "fir tree" configuration, the matching shapes of the root portion and the groove enabling the blade to be securely attached to the periphery of the rotor disk, in particular enabling to limit radial displacement of the blade during rotation at very high speed of the rotor disk.

However, while for enabling an easy assembly of the blade, in particular for enabling easy insertion of the root portion into the corresponding retaining groove, the dimensions of the root portion and retaining groove are such that a clearance or backlash is usually left between the root portion and the retaining groove in order to allow radial and lateral small movements of the root portion with respect to the retaining groove and/or the disk, axial movements of the root portion need to be avoided.

To this end, in particular for the purpose of securely locking the blade to the rotor disk, several conventional solutions have been proposed. For instance, solutions are known according to which tab washers are inserted into the retaining groove (between the root portion and the groove). Other solutions are known according to which wedge shaped elements are forced between the root portion and the groove—for instance by means of threaded pins engaging corresponding threaded portions of the wedged shaped elements—wherein, due to the radial thrust action exerted by the wedge shaped elements on both the root portion and the groove, the blade is locked on the rotor disk by friction.

However, the above mentioned conventional solutions for securely locking blades on the rotor disk, have several drawbacks.

A first drawback relates to the special machining needed for the root portion and/or the retaining groove that introduces discontinuities on the groove surface which may turn into stress concentration regions and therefore cause structural weakening. If a thread is present on a rotor groove problems can be even worse because the threads may turn into crack initializations.

Still by way of example, a further drawback relates to the fact that, in many of the conventional solutions threads are present and therefore caulking is needed. However, caulking operations are very often troublesome due to strict assembling requirements. Known friction based or interference based retaining methods, applied to the coupling between the blade root and corresponding groove, depend heavily on assembly and operating conditions and therefore cannot always be employed.

BRIEF DESCRIPTION OF THE INVENTION

The present disclosure relates generally to the assembly of a blade shaped element on a disk shaped support or carrier, and more particularly to a locking set comprising a blade shaped element and locking elements for assembling and locking the blade shaped element on a disk shaped support or carrier.

In one embodiment, a locking set includes a blade for a turbomachine and locking elements that assist assembling and locking the blade on axial entry grooves formed on a circumferential peripheral surface of the rotor disk of a turbomachine.

The present disclosure relates moreover to a turbomachine comprising a rotor disk equipped with a plurality of blades, wherein the blades are mounted on the circumferential peripheral surface of the rotor disk according to the present disclosure.

Embodiments of the disclosure address the above mentioned drawbacks and others affecting the most common conventional solutions according to which elements, in particular blade shaped elements or blades, are locked on a support or carrier, in particular a disk shaped support or carrier or disk.

For example, as further described and claimed herein, an element, in particular a blade shaped element or blade, can be securely and reliably fixed and/or locked on a support or carrier, in particular a rotatable disk shaped element or disk.

Additionally, an element, in particular a blade shaped element or blade, can be firmly—within a small tolerance range—and reliably fixed and/or locked on a support or carrier, in particular a rotatable disk shaped element or disk, according to easy and simple operations, in particular so as to limit or even avoid any need of additional working, for instance groove extra machining, of one or both of the element and support or carrier.

In view of the above identified objects and/or goals, and taking into account the problems and/or drawbacks affecting the solutions according to the prior art, according to one embodiment, the present disclosure relates to a fixing set for fixing a first element, for instance a turbine blade, to a carrier, for instance a turbine rotor. The first element includes a root portion adapted to be inserted into the at least one corresponding groove of the carrier along a predefined inserting direction. The root portion and the at least one groove are shaped to limit displacements of the first element with respect to the carrier along any direction other than the predefined inserting direction—for instance the axial direction. The root portion includes, in turn, a lower end surface, adapted to face a corresponding base surface of the groove, once the root portion is at least partially received in the at least one groove.

The fixing set includes first, second and third locking elements adapted to be inserted in sequence into the at least one groove, between the root portion lower end surface and the groove base surface. The first locking element is configured to be engaged by both the root portion lower end surface and the groove base surface. The second and third locking elements are configured to cooperate in the following way: by inserting the second locking element between the end surface and the base surface, then inserting the third locking element and then pulling back the second element, the third element is engaged by the second locking element and the second element is retained in position due to the plastic deformation or change of shape and geometry of the second element thus preventing any reversibility of assembly unless destruction of the second element.

BRIEF DESCRIPTION OF THE DRAWINGS

These and other features and aspects of the present disclosure will become better understood when the following detailed description is read with reference to the accompanying drawings in which like characters represent like parts throughout the drawings, wherein.

DETAILED DESCRIPTION OF THE INVENTION

The following disclosure refers to a fixing set or locking set for securely assembling and locking a blade shaped element, for instance a turbine blade, on a support or carrier, for instance a turbine rotor. The blade shaped element is adapted to be inserted into a groove of the external surface of the support and the fixing set includes first, second and third locking elements adapted to be inserted into the groove, between the lower end surface of the root portion of the blade shaped element and the groove base surface. The first, second and third locking elements are further adapted to allow easy and simple installation with no need of additional working, like for instance groove extra machining, which is required for the conventional locking systems.

Figure 1:
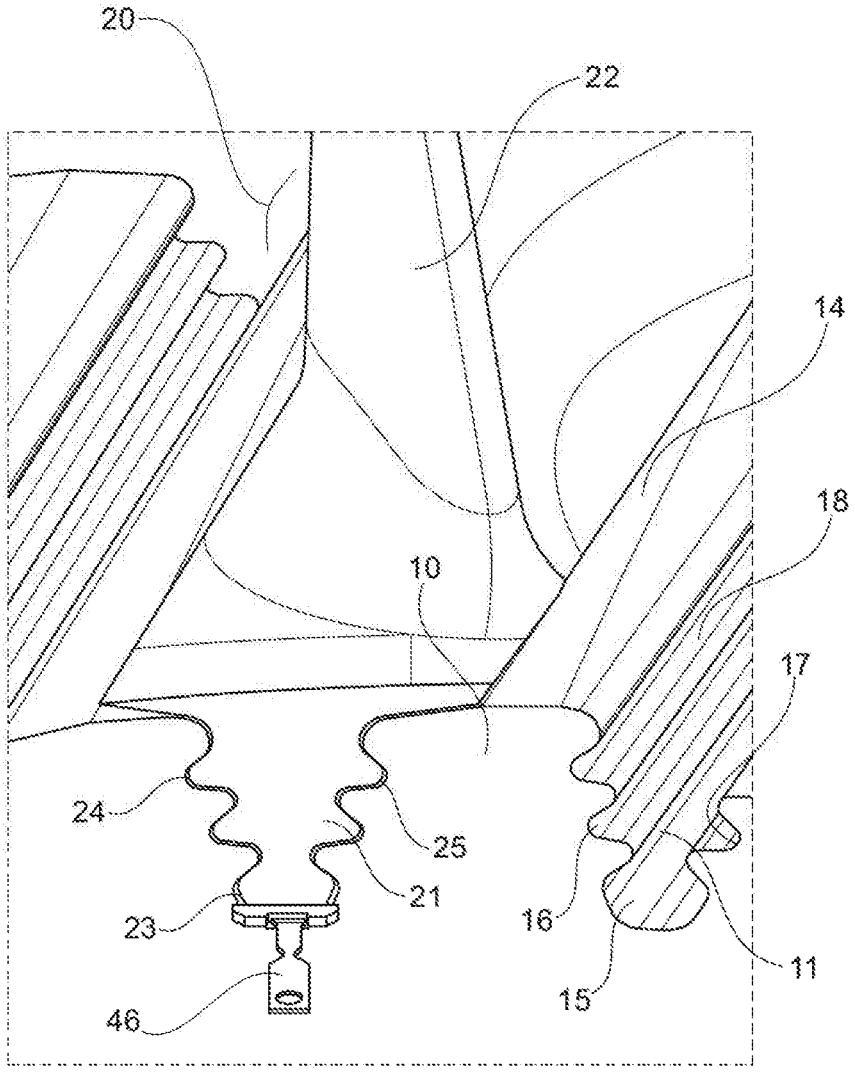
FIG. 1 shows a front view of a carrier 10 and an element 20 mounted thereon.

With reference to FIG. 1, depicted therein are a carrier 10 and an element 20 mounted thereon.

In the following description, for the sake of convenience and clarity, the carrier 10 and the element 20 will be referred to as a "rotor disk"—for instance of a turbomachine—and a "blade", respectively, although applications of the present disclosure are not limited to a rotor disk and a corresponding blade.

Figure 2:
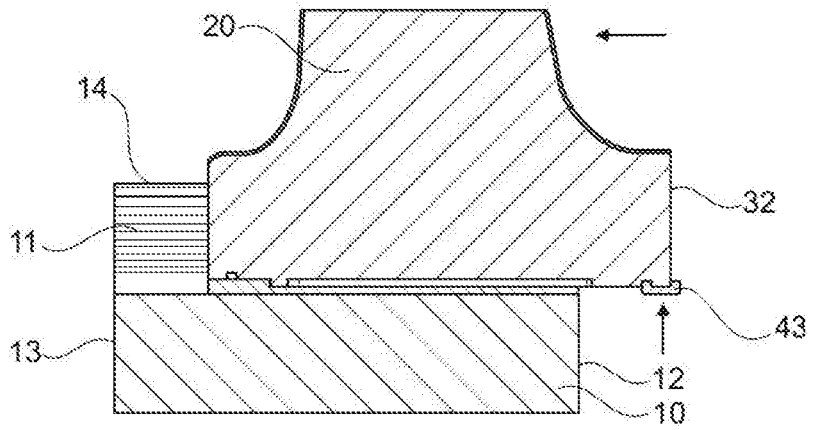
FIGS. 2, 3, 4, 5 and 6 show sections of the carrier 10 and the element 20 during corresponding steps of the assembling procedure for assembling and locking the element 20 on the carrier 10.

The rotor disk 10 is rotatable on a rotation axis and, as shown on FIG. 2, comprises two opposite lateral surfaces 12, 13 joined by a cylindrical peripheral surface 14, wherein each of the opposite rotor disk 10 lateral surfaces 12 and 13 lies on a plane substantially perpendicular to the rotor disk axis of rotation, whilst the peripheral surface 14 is a portion of a cylindrical surface with longitudinal axis corresponding to the rotor disk axis of rotation.

Between the opposite rotor disk 10 lateral surfaces 12 and 13, a substantially axial (apart from a possible skew) entry groove 11 extends, the groove comprising a base surface 15 and opposite flank surfaces 16 and 17, along with a peripheral aperture 18 by means of which the groove 11 is in communication with the space around the disk 10 in correspondence of its peripheral surface 14.

As to the blade 20, same comprises an airfoil portion 22 shaped and configured so as to convey and/or pressurize and/or expand a fluid (or gas) during rotation of the disk 10, along with a root portion 21 by means of which the blade 20 is mounted on the disk 10. In particular, as apparent from FIG. 1, in the cross or transverse direction (with respect to the rotor rotation axis), the root portion 21 and the groove 11 have corresponding and matching shapes and dimensions, meaning that the root portion 21 comprises an end surface 23 (facing the base surface 15 of the groove 11 once the blade 20 is mounted on the disk 10 as depicted in FIG. 1), along with two opposite lateral or flank surfaces 24 and 25 facing the opposite lateral or flank surfaces 16 and 17 of the groove 11, respectively.

In the embodiment as depicted in FIG. 1, the shapes of the root portion 21 and the groove 11 are such as to define, in combination, a so called "dovetail" connection between the blade 20 and the disk 10, in particular between the root portion 21 and the retaining groove 11, thus allowing the root portion 21 to be translated with respect to the groove 11, for instance during insertion and extraction of the root portion 21 into and from the groove 11, but limiting the displacements of the root portion 21 with respect to the groove 11 along directions other than the axial direction (apart from a possible skew), for instance along radial directions, in particular during rotation of the disk 10.

It has however to be considered that the present disclosure is adapted to be implemented and carried out in combination with root portions and corresponding retaining grooves of any shape and not only "dovetail" shaped as depicted in FIG. 1; for instance, root portions of the "fir tree" type fall within the scope of the present disclosure.

Moreover, and still for the sake of clarity, it has to be understood that although in FIG. 1 there is depicted a unique or single groove 11 with a corresponding root portion 21 received therein, in several applications, for instance in the case of the rotor disk of a turbomachine, a plurality of retaining grooves may be formed on the disk, each extending down from its peripheral surface and receiving a corresponding root portion of a blade or blade shaped element.

As depicted in FIG. 1, the reciprocal dimension of the root portion 21 and the retaining groove 11 are such that, with the root portion 21 simply received inside the groove 11, but not yet securely locked, a clearance is left between the root portion 21 and the groove 11, meaning that small displacements—in particular along the radial direction—of the root portion 21 and the blade 20 with respect to respectively the groove 11 and the disk 10 are still possible. The clearance allows easy insertion of the root 21 into the groove 11.

Figure 7:
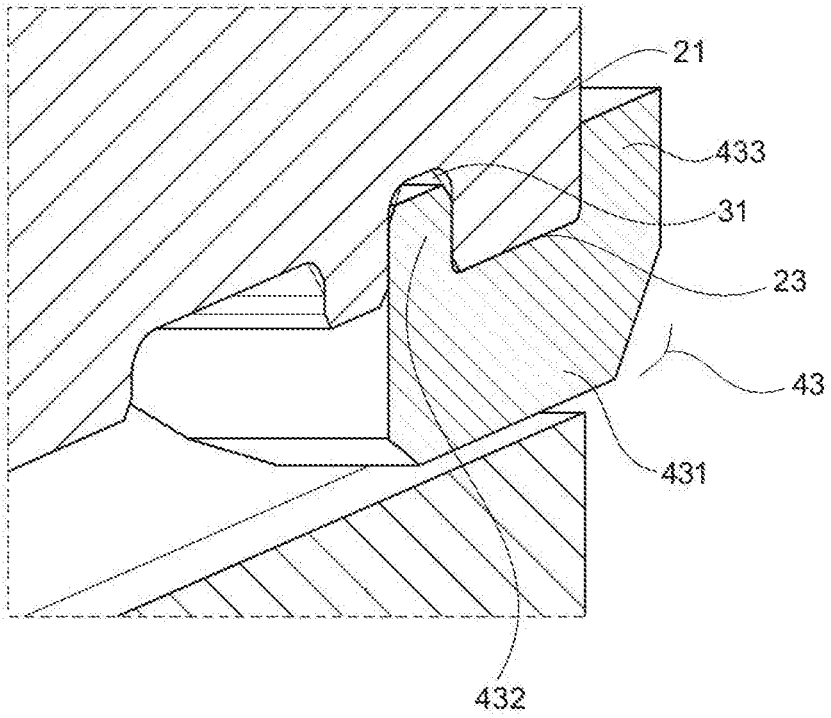
FIGS. 7 and 8 show corresponding enlarged perspective views, in partial section, of the carrier 10 and the element 20 mounted thereon.
Figure 8:
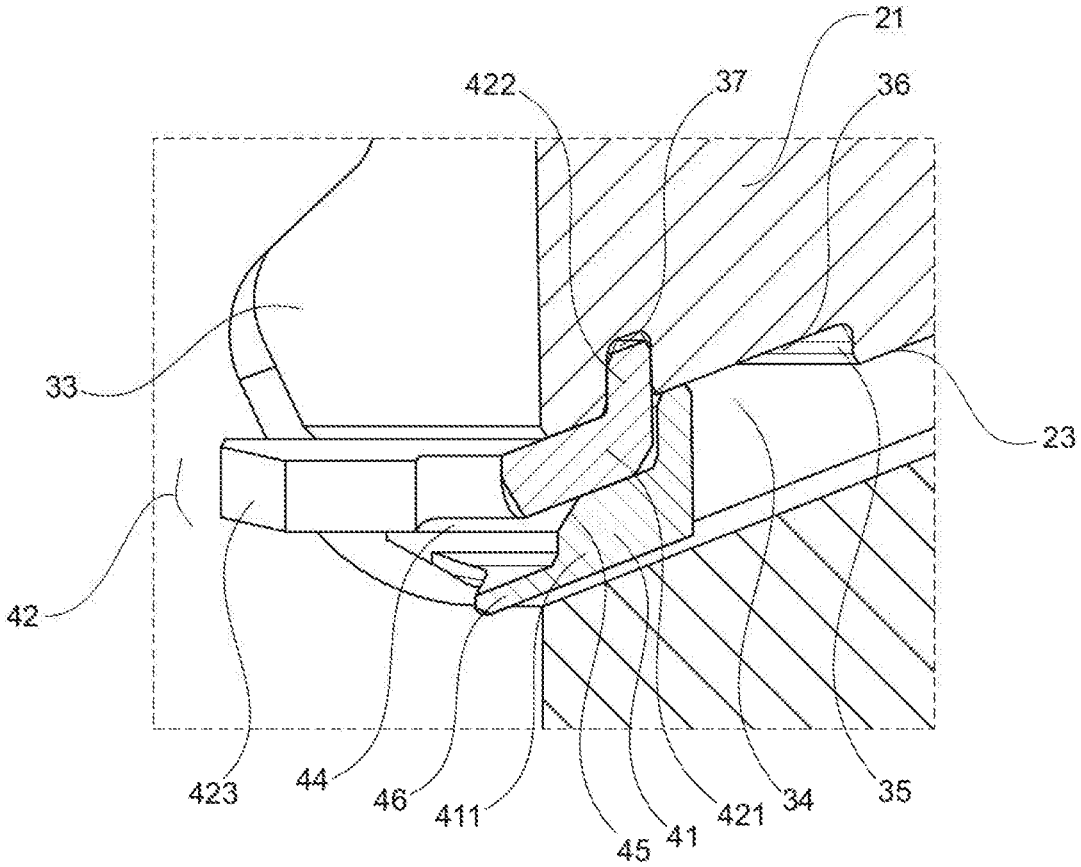

As depicted in the figures (see in particular FIGS. 2 and 7), the root portion 21, in the axial direction (substantially parallel to the direction along which the root portion 21 is inserted into the groove 11), is delimited by first and second opposite root portion 21 lateral surfaces 32 and 33, and comprises a first slot 31 which extends into the root portion 21 from the end surface 23 of the root portion 21 and is located close to the first lateral surface 32 of the root portion 21. The first slot 31 has a substantially rectangular cross shape and extends between the lateral flank surfaces 24 and 25 along a direction substantially perpendicular to the axial direction of rotor and parallel to the root portion 21 first lateral surface 32 and to the rotor disk 10 lateral surfaces 12 and 13. On the opposite side of the root portion 21 (still in the axial direction) there is formed a sink 34 which extends in the longitudinal direction from the second lateral surface 33 to a predefined axial width, and as well from the end surface 23 (to a predefined radial depth, again between the lateral flank surfaces 24 and 25. The sink 34 has a substantially rectangular cross shape, with a surface 35 located at a predetermined axial distance from the second lateral surface 33 (the distance corresponding to the axial depth of the sink 34), and a surface 36 located at a predetermined distance from the second end surface 23 (the distance corresponding to the radial width of the sink 34). Moreover, a second slot 37 is formed in the sink 34 so as to extend into the root portion 21 from the surface 36 of the sink 34, the second slot 37 being located close to the second lateral surface 33 of the root portion 21. The second slot 37 is similar to the above mentioned first slot 31, and has therefore a substantially rectangular cross shape and extends between the lateral flank surfaces 24 and 25 along a direction substantially perpendicular to the axial direction and parallel to the root portion 21 second lateral surface 32.

Depicted in the drawings are moreover first, second and third locking elements 43, 41 and 42. The first 43 and third 42 locking elements have similar U shapes, with base portions 431, 421, and parallel protrusions 432, 422 extending therefrom, respectively. The second locking element 41 comprises a plate shaped main body 411 in an embodiment inclined abutment surface 44 which defines a wedge shaped abutment portion 45; moreover, the second locking element 41 comprises a pull tab 46 to be described in more detail in the following.

Protrusion 432 of the first locking element 43 is adapted to be inserted into the first slot 31 as depicted in the drawings; in the same way, protrusion 422 of the third locking element 42 is adapted to be inserted into the second slot 37, still as depicted in the drawings.

Protrusion 433 of the first locking element 43 and protrusion 423 of the third locking element 42 are adapted to axially project outside of and engaging with the lateral surfaces 12, 13 of the rotor 10 and the lateral surfaces 32, 33 of the blade root portion 21.

The engaging of protrusion 432 of the first locking element 43 and protrusion 422 of the third locking element 42 with the slots 31 and 37 respectively, and the engaging of protrusion 433 of the first locking element 43 and protrusion 423 of the third locking element 42 with the lateral surfaces 12, 13 of the rotor 10 and the lateral surfaces 32, 33 of the blade root portion 21 allow preventing the blade to move axially with respect to the rotor body.

In the following, description will be given of how the locking elements 41, 42 and 43 are used according to the present disclosure for the purpose of securely locking the blade 20, through its root portion 21, inside the retaining groove 11.

As apparent from FIG. 2, during a first step as depicted therein, the root portion 21 is inserted into the groove 11 as indicated by the arrow and substantially as described above; however, the first locking element 43 is applied to the root portion with protrusion 432 received inside the first slot 31, wherein within the scope of the present disclosure, applying the first locking element 43 to the root portion 21 does not necessarily mean fixing the element 43 to the root portion 21, but simply keeping, for instance by the operator's hand or by gravity pull or by applying glue or some other adhesive material, the locking element 43 with its protrusion 432 placed inside the groove 31 during the insertion of the blade inside the corresponding rotor groove.

Figure 3:
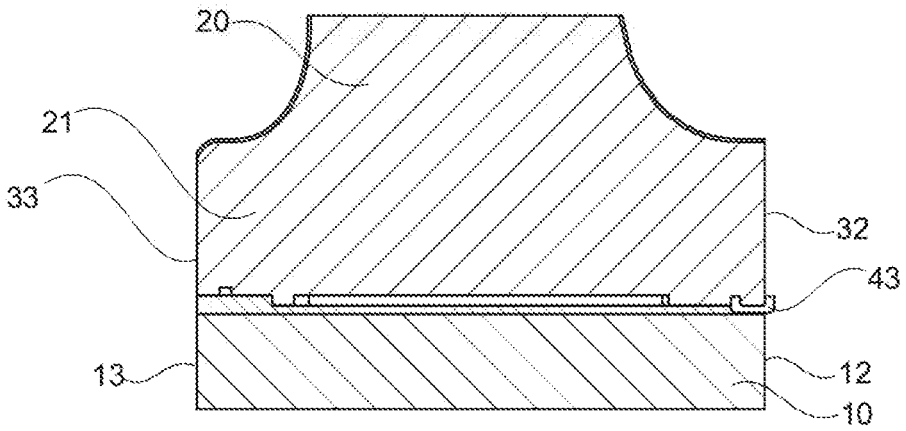

During the next step as depicted in FIG. 3, the root portion 21 and the first locking element 43 are inserted into the retaining groove 11, in particular into the clearance between the end face 23 of the root portion 21 and the base surface 15 of the groove 11, thanks to the fact that the protrusion 432 is received inside the first slot 31. The blade is thus inserted in the rotor's groove until protrusion 433 gives a first axial end stop to the travel of the blade within the groove 11 by engaging with the lateral surface 12 of the rotor 10 and with the lateral surface 32 of the root portion 32 together.

The thickness of the base portion 431 of the first locking element 43 is substantially equal to or is a little bit less than the clearance between the blade root and the corresponding rotor groove.

Figure 4:
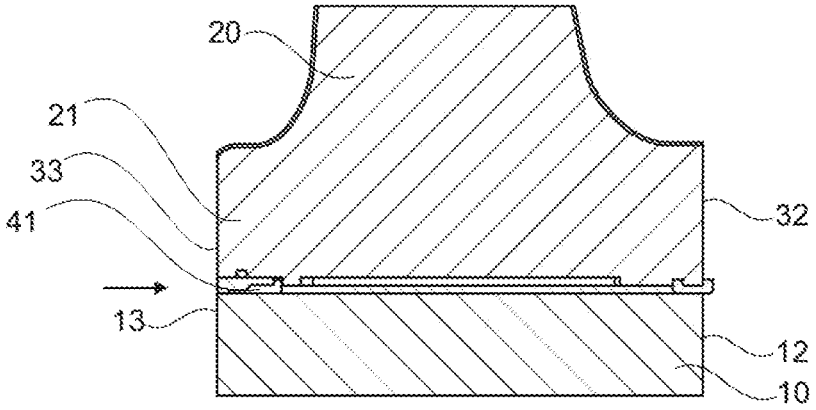
Figure 5:
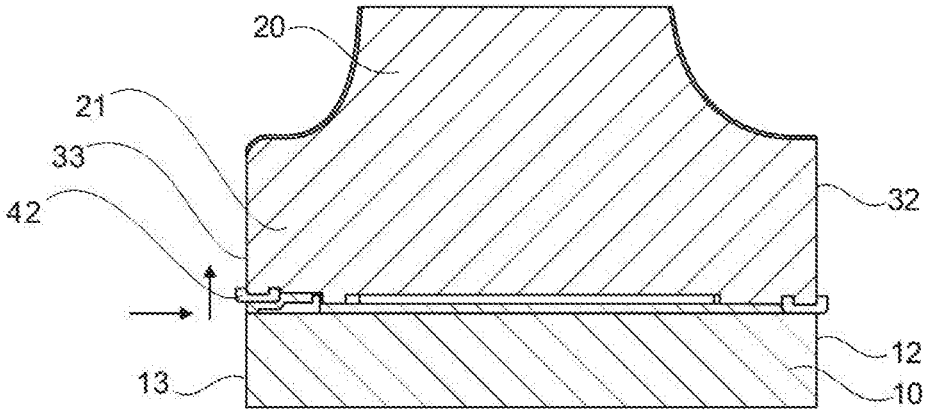

Once the root portion 21 has reached its end stroke position in the axial direction of insertion and, correspondingly, the first locking element 43 is engaged between the root portion 21 and the rotor 10, in the next step, as depicted in FIG. 4, the second locking element 41 is inserted into the sink 34 along a direction of insertion substantially opposite to the direction along which the root portion 21 has been previously inserted into the rotor retaining groove 11; during this step, no particular efforts are needed, due to the fact that the depth of the sink 34 is larger than the thickness of the base portion 411 of the second locking element 41. Subsequently, during the further step as depicted in FIG. 5, the third locking element 42 is applied to the root portion 21, with its protrusion 422 received inside the second slot 37, wherein, within the scope of the present disclosure, applying the third locking element 42 to the root portion 21 may mean again simply keeping, for instance by the operator's hand, the third locking element 42 with its protrusion 422 inside the slot 37. It has moreover to be noted that the insertion of the third locking element 42 into the sink 34 is not obstructed by the second locking element 41, since the width of the sink 34 is larger than the width of the element 41 and the depth of the sink 34 is larger than the thickness of the second element 42. The depth of the sink 34 is at least a little bit larger than the sum of the thicknesses of the base body 411 of the second element 41 and the base portion 421 of the third locking element 42.

Figure 6:
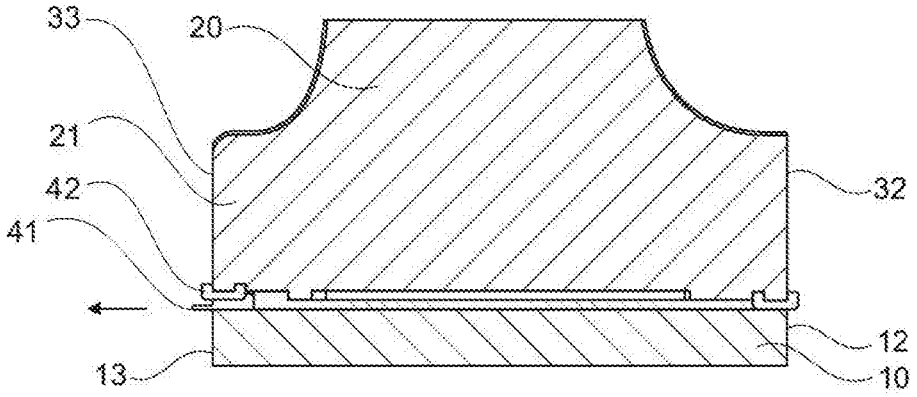

During the further step as depicted in FIG. 6, the second locking element 41 is pulled (for instance acting on the pulling tab 46 by hands or by means of a tool), along a direction of extraction (from right to left with respect to the drawings) substantially opposite to the direction along which it was inserted before into the sink 34. During the translation of the element 41 toward outside the sink 34, the second locking element 41 comes into abutment against the third locking element 42 which may not be pushed out of the sink 34 due to the reciprocal action of the second slot 37 and the protrusion 422 received therein. Accordingly, the second locking element 41 (or at least its base body 411) is pulled between the third locking element 42 and the base surface 15 of the groove 11, whilst the third locking element 42 engages between the second locking element 41 and the root portion 21.

In a further final step, the pulling tab 46 of the second locking element 41 is bent, in an embodiment in the same direction of the centrifugal force developing during the rotor operation. Then the pulling tab 46 is removed, for instance by cutting by means of a chisel or the like. This way the assembling described above is irreversible and the blade 20 is securely locked inside the retaining groove 11. The blade 20 is therefore axially blocked between the protrusions 423 and 433 with respect to the rotor lateral surfaces 12, 13, within a predetermined tolerance range, regardless the exerted assembly forces, the friction forces etc.

It has therefore been unambiguously demonstrated that the present disclosure can overcome the drawbacks mentioned above.

Although the present disclosure has been clarified by means of the above detailed description of the embodiments thereof as depicted in the drawings, the present disclosure may not be understood as being limited to the embodiments disclosed above and depicted in the drawings. For instance, the third locking element 43 may be manufactured integral with the blade 20 and it may also be omitted depending on the needs and/or circumstances.

Various embodiments of the invention may be contained in the following clauses, which unless otherwise noted, may be combined in any fashion.

According to an embodiment of the disclosure, the lower end surface may comprise a first sink in correspondence of a first end of the root portion, the first locking element being adapted to be inserted into the first sink.

According to a further embodiment the lower end of the root portion may comprise a second sink in correspondence of a second end of the root portion, opposite to the first end portion, the second and third locking elements being adapted to be inserted in sequence into the second sink.

According to a further embodiment, the set may further comprise first stopping means adapted to avoid or at least limit displacement of the first locking element with respect to the root portion during insertion of the root portion into the at least one groove.

According to a further embodiment, the set may further comprise second stopping means adapted to avoid or at least limit displacement of the third locking element when the third locking element is engaged by the second locking element.

Still according to a further embodiment, the first stopping means may comprise a first slot defined within the first sink and a protrusion extending from the first locking element and adapted to engage the first slot.

Still according to a further embodiment, the second stopping means may comprise a second slot defined within the second sink and a protrusion extending from the third locking element and adapted to engage the second slot.

According to a further embodiment, the set may further comprise third stopping means adapted to avoid displacement of the root portion with respect to the at least one retaining groove after insertion of the root portion into the at least one retaining groove.

Still according to a further embodiment, the third stopping means may comprise protrusion of the first locking element and protrusion of the third locking element adapted to axially project outside of and engaging with the lateral surfaces of the rotor and the lateral surfaces of the blade root portion.

According to a further embodiment, the second locking element may comprise a main engagement portion and a pulling portion, the pulling portion being configured so as to allow the main engagement portion to be pulled into engagement with the third locking element.

Still according to a further embodiment, the pulling portion may be adapted to be removed from the main engagement portion after plastic deformation of the second locking element, at the end of the blade assembly.

Still according to a further embodiment, the first sink may have a depth which is less than the depth of the second sink.

According to a further embodiment, the first element is configured as a blade of a turbomachine, and the root portion is adapted to be inserted into at least one corresponding groove of a rotor-like component along the predefined inserting direction substantially parallel—apart from a possible skew—to the axis of rotation of the rotor-like component.

The present disclosure further relates to a turbomachine comprising a rotor with a rotating rotor disk, the rotor disk comprising a plurality of receiving grooves disposed along the circumferential peripheral surface of the rotor disk, each of the grooves extending radially from the circumferential peripheral surface of the rotor disk, the rotor further comprising a plurality of blade assemblies according to one of the above summarized embodiments, each of the blades being fixed to the circumferential periphery of the rotor disk as a result of the insertion of its root portion into a corresponding groove of the plurality of grooves.

According to a further embodiment, the rotor disk may comprise first and second opposite lateral surfaces crossed by the axis of rotation of the rotor disk and reciprocally joined by the circumferential peripheral surface of the rotor disk, and for each of the blades the first sink is positioned in proximity of one of the first and second opposite lateral surfaces of the rotor disk.

Still according to an embodiment, for each of the blades the second sink is positioned in proximity of the lateral surface of the rotor disk opposite to the lateral surface of the rotor disk in proximity of which there is positioned the first sink.

The above description of exemplary embodiments refers to the accompanying drawings. The same reference numbers in different drawings identify the same or similar elements. The following detailed description does not limit the disclosure. Instead, the scope of the disclosure is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fixing set comprising:

a carrier including at least one retaining groove, a first element comprising a root portion adapted to be inserted into the at least one retaining groove along a predefined inserting direction, wherein the root portion comprises an end surface adapted to face a corresponding base surface of the at least one retaining groove once the root portion is at least partially received in the at least one retaining groove of the carrier, and first, second and third locking elements adapted to be inserted into the at least one retaining groove between the end surface and the base surface, wherein the first and third locking elements are adapted to engage with the end surface and to further engage with a lateral surface of carrier and a lateral surface of the root portion to prevent the root portion to move axially with respect to the carrier, and wherein the second locking element includes a pull tab configured to be pulled to cause the second locking element to engage between the third locking element and the base surface and to block the third locking element in place.

2. The fixing set according to claim 1, wherein the end surface comprises:

a first main portion; and a second portion, wherein the second portion defines a first sink in correspondence of a second lateral surface of the root portion, and wherein the second and third locking elements are adapted to be inserted in sequence into the first sink.

3. Fixing set according to claim 1, wherein the root portion comprises a first slot extending into the root portion from the end surface and the first locking element comprises a protrusion adapted to engage the first slot.

4. The fixing set according to claim 1, wherein the root portion comprises a second slot extending into the root portion from the second surface portion of the first sink and the third locking element comprises a protrusion adapted to engage the second slot.

5. The fixing set according to claim 1, wherein the pull tab is adapted to be removed from a main engagement portion of the second locking element.

6. The fixing set according to claim 1, wherein the first locking element comprises a protrusion adapted to axially project outside of and engaging with the lateral surfaces of the rotor and the lateral surfaces of the blade root portion.

7. The fixing set according to claim 1, wherein the third locking element comprises a protrusion adapted to axially project outside of and engaging with the lateral surfaces of the rotor and the lateral surfaces of the blade root portion.

8. The fixing set according to claim 1, wherein the carrier is configured as a disk shaped rotatable carrier and the first element is configured as a blade of a turbomachine, and the root portion is adapted to be inserted into the at least one retaining groove of the disk shaped rotatable carrier along the predefined inserting direction substantially parallel to the axis of rotation of the disk shaped rotatable carrier.

9. A rotor element assembly for a turbomachine, the rotor element assembly comprising at least one rotor disk with at least one receiving groove extending into the rotor disk from the circumferential peripheral surface of the rotor disk, the rotor element assembly further comprising at least one fixing set according to claim 1.

10. A turbomachine comprising the rotor element assembly according to claim 9.

11. The turbomachine according to claim 10, comprising a plurality of the rotor element assemblies disposed along a common axis of rotation.

12. The turbomachine according to claim 10, the turbomachine further comprising a stator, the at least one rotor elements or plurality of rotor elements being received inside the stator.

* * * * *